United States Patent [19]

Naruse

[11] Patent Number: 4,719,604

[45] Date of Patent: Jan. 12, 1988

[54] REFLECTIVE OBJECT DETECTOR WITH COMPENSATED RECEIVER SIGNAL

[75] Inventor: Yoshihiro Naruse, Tokyo, Japan

[73] Assignee: Aisin Seiki Kabushikikaisha, Japan

[21] Appl. No.: 885,638

[22] Filed: Jul. 15, 1986

[30] Foreign Application Priority Data

Jul. 16, 1985 [JP] Japan ..... 60-156254

[51] Int. Cl.[4] ..... G08B 13/16

[52] U.S. Cl. ..... 367/93; 340/552; 340/554; 367/94

[58] Field of Search ..... 367/93, 94; 340/552, 340/554

[56] References Cited

U.S. PATENT DOCUMENTS

| | | | |
|---|---|---|---|
| 3,955,171 | 5/1976 | Skoures et al. | 367/94 |
| 4,193,055 | 3/1980 | Barnum | 367/94 |
| 4,542,489 | 9/1985 | Naruse | 367/93 |
| 4,608,674 | 8/1986 | Guscott | 367/94 |

FOREIGN PATENT DOCUMENTS

| | | |
|---|---|---|
| 56099 | 4/1982 | Japan . |
| 166499 | 10/1982 | Japan . |
| 163881 | 10/1982 | Japan . |

*Primary Examiner*—Glen R. Swann, III

*Attorney, Agent, or Firm*—Sughrue, Mion, Zinn, Macpeak and Seas

[57] ABSTRACT

To accommodate for a change in the level of a received wave which occurs as a function of the distance between an object, the existence of which is to be detected, and a detector, the detector includes a receiver circuit which has an amplifier circuit having a gain which changes exponentially with an elapsed time since an ultrasonic wave has been transmitted. The amplifier circuit includes ramp signal generating means having an output level which changes in proportion to an elapsed time since a control signal assumes its on level, non-linear signal processing means for non-linearly processing a signal which is output from the ramp signal generating means, and a variable amplification amplifier having an amplification factor which depends on a signal level which is output from the non-linear signal processing means.

11 Claims, 17 Drawing Figures

REFLECTIVE OBJECT DETECTOR WITH COMPENSATED RECEIVER SIGNAL

BACKGROUND OF THE INVENTION

The invention relates to a reflective object detector which includes object detecting means which utilizes a signal such as ultrasonic wave, for example, for detecting the presence or absence of an object in response to the presence or absence of a reflected signal, and in particular, is directed to such detector which is capable of detecting an object located in an extended range of distances with an increased speed of determination.

When transmitting or receiving an ultrasonic wave, for example, the level of the received wave changes with the distance between the transmitting and the receiving points, even though the transmission level is maintained constant. Accordingly, if the ultrasonic transceiver has a reduced sensitivity as a whole, an object located at an increased distance results in a greatly reduced level of the received signal, preventing such object from being detected. Conversely, if an apparatus has a high sensitivity, the level of the received signal will rise to a very high value for measurement directed to reduced distances, causing the likelihood that noises induced by an electrical signal or the direct ultrasonic wave may be inadvertently detected. It is seen therefore that an adjustment of the sensitivity is required to enable the detection of an object over a broad range from a near to a far distance. By way of example, U.S. Pat. No. 4,542,489 discloses an arrangement in which a region to be monitored is divided into a plurality of sections, and the sensitivity is adjusted stepwise for each of the sections.

However, it is difficult to switch the sensitivity at high speed. For example, if an analog multiplexer is used to change resistors which determine the amplification factor of a receiver, an abnormal change in the gain may occur or switching noises may be developed during the switching operation. This prevents an accurate detection at a timing at which the sensitivity is switched. In other words, a continuous measurement is inhibited. For this reason, in the arrangement of the U.S. patent, the sensitivity is changed after each measurement. Thus, the ultrasonic wave is transmitted intermittently, and the sensitivity is adjusted at the interval of such transmission. This requires a plurality of measurements to monitor the entire region which extends over an extended range of distances. In order to prevent the influence of an ultrasonic wave which has been transmitted previously, it is necessary to provide a waiting time of a given length from the termination of one measurement until the next measurement can be initiated. The interval between successive measurements must be chosen to be a relatively high value which may be on the order of several tens of milliseconds. Since a number of waiting times is required to monitor the entire region, the overall time required for the measurement increases. Where a vehicle or an object moves relatively rapidly, a detection lag is likely to occur. In particular, if a plurality of detector units are located at spaced points, and measurements are made at successively different locations so as to cover a broad range, the total time required for the measurement will be very long.

SUMMARY OF THE INVENTION

It is an object of the invention to provide a reflective object detector which is capable of completing the detection of an object or objects located over an extended range of distances within a reduced length of time.

The above object is accomplished in accordance with the invention, by providing amplifier means having an amplification factor which continuously changes with time according to a given exponential curve when a control signal assumes an on level. The amplifier means receives a signal which is delivered from a signal receiver means. The control signal is switched to its on level substantially at the same time a signal, for example, an ultrasonic wave, is transmitted.

When an ultrasonic transmitter and an ultrasonic receiver are located close to each other with the transmitting and the receiving axis disposed in alignment with each other, and an ultrasonic wave of a given level is transmitted from the ultrasonic transmitter, the ultrasonic sound pressure P(r) which impinges upon the ultrasonic receiver after the transmitted wave is reflected by an object located at a distance r from the transmitter and the receiver will be given by the following equation $$P(r)=(P_0/r)\cdot e^{\alpha} \tag{1}$$

where P(r) represents an absolute value, $P_0$ represents the sound pressure at $r=0$, $\alpha=-2k_1r$, and $k_1$ represents an absorption coefficient In other words, the ultrasonic sound pressure which reaches the ultrasonic receiver varies as an exponential function of the distance between the detector and an object to be detected. On the other hand, time T(r) which is required for the ultrasonic wave reflected by an object, located at a distance r from the transmitter and the receiver to reach the receiver after it has been transmitted from the transmitter can be expressed as follows:

$$T(r)=2r/v \tag{2}$$

where v represents the propagation velocity of the ultrasonic wave. Since the velocity v may generally be considered as constant, T(r) is proportional to the distance r. Accordingly, the ultrasonic sound pressure P(t) which reaches the ultrasonic receiver at a given time interval t after the ultrasonic wave is transmitted is expressed as follows:

$$P(t)=(P_1/t)\cdot e^{\alpha} \tag{3}$$

where $\alpha=-2k_1t$, and is different from $\alpha$ used in the equation (1), and $P_1$ represents the sound pressure at $t=0$. Thus, the sound pressure of the ultrasonic wave received generally changes as an exponential function of the elapsed time t since the transmission of the ultrasonic wave.

An electrical signal which is delivered from the ultrasonic receiver has a level which is generally proportional to the sound pressure level at the receiver Accordingly, a voltage V(t) which appears at the output of the ultrasonic receiver at a time interval t after the ultrasonic wave has been trasmitted is expressed as follows:

$$V(t)=k_2\cdot(P_1/t)\cdot e^{\alpha} \tag{4}$$

where $\alpha = -2k_1t$ and $k_2$ represents a coefficient which is determined by the response of the ultrasonic receiver. Thus, it is seen that an output voltage from the ultrasonic receiver generally changes as an exponential function of the interval t since the ultrasonic wave has been transmitted. Accordingly, by connecting amplifier means having an amplification factor G(t) which changes with t according to an exponential function defined by the equation (5), given below, which is the inverse of the exponential function defined by the equation (4) for the voltage V(t), to the output of the ultrasonic receiver, there is obtained a voltage at the output of the amplifier means which has a constant level independent from the distance r between the detector and the object.

$$G(t) = k_3 \cdot (t/e^{\alpha}) \quad (5)$$

where $\alpha = -2k_1t$, and $k_3$ represents a coefficient. Thus, in accordance with the invention, a change in the receiving level which occurs in dependence upon the distance between the detector and the object is automatically compensated for by the amplifier means, avoiding the need to change the receiver sensitivity stepwise. Accordingly, a single transmission of the ultrasonic wave is all that is required to conduct a measurement over the entire range of distances, thus greatly reducing the time required for the measurement. In addition, an inadvertent detection of the direct wave is prevented for small distances while allowing the existence of an object to be detected at an increased distance.

In an embodiment to be described later, the amplifier means comprises means for generating a ramp signal having an output level which changes in proportion to the time passed since the control signal is switched to its on level, non-linear signal processor means connected to the output of the ramp signal generating means, and variable amplification factor amplifier having an amplification factor which depends on a signal level output from the non-linear signal processor means.

Using the amplifier means having an amplification factor which varies according to a given exponential function as defined by the equation (5), a signal having a constant level is generally obtained independent from the distance. However, the absorption coefficient $k_1$ does not remain constant for the ultrasonic wave which propagates through the air, and it is also difficult to provide a uniform response for the non-linear signal processor means and a variable amplification factor amplifier. When the amplification factor G(t) is changed according to a predetermined curve, the resulting change does not match the actual change in V(t). Accordingly, in a preferred embodiment of the invention, the means for generating the ramp signal is provided with ratio regulating means which regulates the ratio of the output level to the time which has passed since the transmission of the ultrasonic wave, and the non-linear signal processor means includes signal conversion means and bias adjusting means which adjusts a bias level applied to the signal conversion means. In this manner, the amplification factor G(t) of the amplifier means can be made to match an optimum response.

DESCRIPTION OF PREFERRED EMBODIMENT

Figure 1:
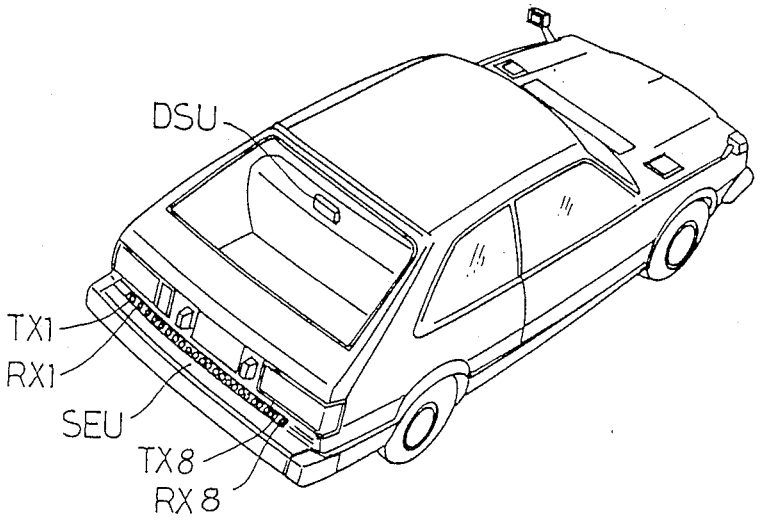
FIG. 1 is a perspective view showing the appearance of an automobile on which the apparatus of the invention is mounted.

Referring to the drawings, an embodiment of the invention will now be described. FIG. 1 shows an automobile on which a reflective object detector of the invention is mounted. In this Figure, a detector unit SEU is disposed horizontally at a location slightly raised above a rear bumper of the automobile, in this example. The unit has an active surface which is directed rearward of the automobile. The unit SEU comprises an array of eight ultrasonic transmitters TXl to TX8 and eight ultrasonic receivers RXl to RX8, which are alternately arranged. A display unit DSU is disposed on the top of the rear seat.

Figure 2B:
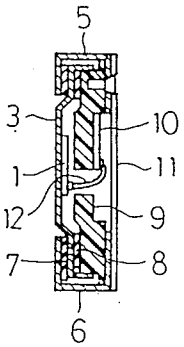
FIGS. 2*a*, 2*b* and 2*c* are a plan view of part of a detector unit SEU mounted on the automobile shown in FIG. 1, a cross section taken along the line IIb—IIb shown in FIG. 2*a*, and a cross section taken along the line IIc-IIc shown in FIG. 2*a*.
Figure 2A:
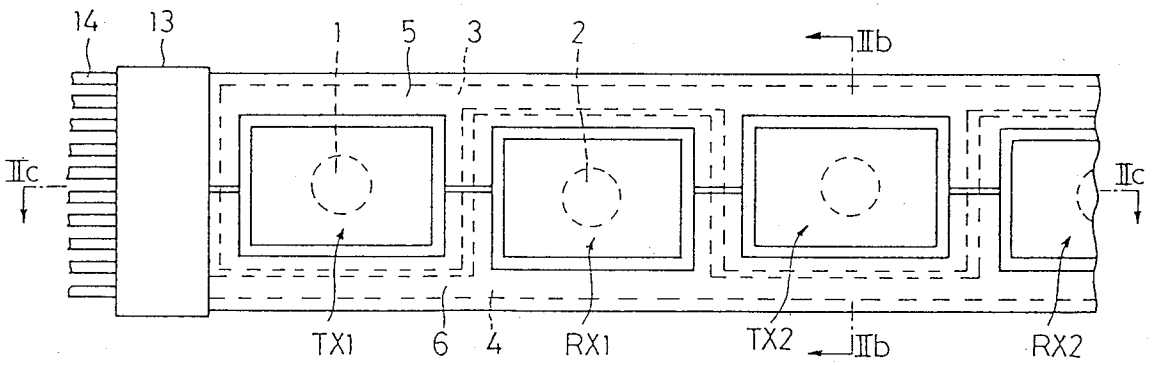
Figure 2C:
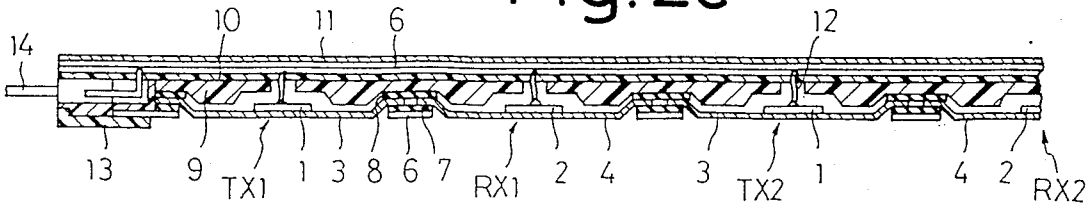

FIGS. 2*a*, 2*b* and 2*c* show part of the detector unit SEU, it being understood that a portion not illustrated being constructed in the same manner as the portion illustrated. As shown, ultrasonic transmitters TX1, TX2 . . . and ultrasonic receivers RX1, RX2 . . . are disposed in an alternating manner. Both a transmitting element 1 and a receiving element 2 comprise a piezoelectric element. The transmitting element 1 of each of the ultrasonic transmitters TX1, TX2 . . . is supported by being secured to a metallic diaphragm 3 while the receiving element 2 of each of the ultrasonic receivers RX1, RX2 . . . is supported by being secured to a metallic diaphragm 4. It will be noted that each of the diaphragms 3 and 4 is defined in the form of a comb, with its projection or vibrating portion being disposed in staggered fashion with respect to each other. A small clearance is left between the diaphragms 3 and 4 to separate them. A casing for the detector unit SEU is formed by a pair of metallic members 5, 6, and a resin spacer 9 is disposed within the casing. The diaphragms 3 and 4 are supported by the members 5 and 6 and the spacer 9 with rubber buffering members 7 and 8 interposed therebetween. It will be noted that a relatively large space is left around the transmitting element 1 and the receiving element element 2, respectively. A printed circuit board 10 having a wiring pattern of conductors (not shown) is secured to part of the spacer 9. Lead wires 12 extending from each transmitting element 1 and receiving element 2 are connected through the wiring pattern to individual terminals 14 of a connector 13 which is mounted on the end of the detector unit SEU. A plate-shaped magnet 11 is secured to the back surface of the casing (5, 6)

in order to allow the detector unit SEU to be mounted on the car body.

Figure 3:
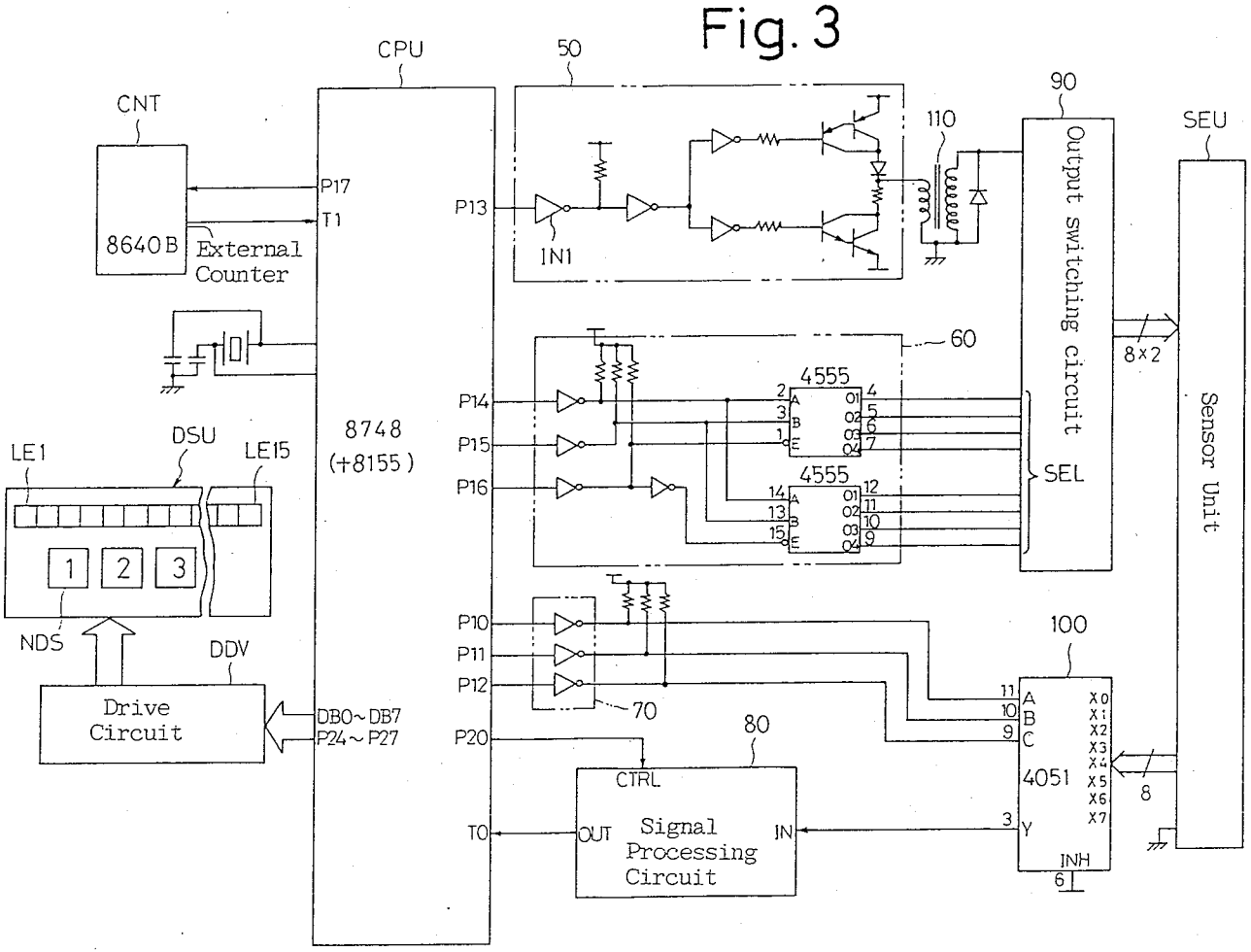
FIG. 3 is a block diagram of the electrical circuit of the object detector mounted on the automobile shown in FIG. 1.

FIG. 3 shows the general arrangement of the electrical circuit of the object detector which is mounted on the automobile shown in FIG. 1. Referring to FIG. 3, the circuit comprises a microcomputer CPU, a drive circuit 50, a step-up transformer 110, a transmitter output switching circuit 90, a decoder 60, a receiver switching circuit 100, an inverter 70, a detector unit (or sensor unit) SEU, a signal processing circuit 80, an external counter CNT, a display drive circuit DDV and a display unit DSU.

The drive circuit 50 comprises a power amplifier having an output defined by complementary transistor pairs. The drive circuit 50 is effective to amplify a binary signal of TTL level which is output on an output port P13 of the microcomputer CPU for application to the primary winding of the step-up transformer 110. A high voltage pulse signal is induced across the secondary winding of the transformer 110 and is applied to the output switching circuit 90. The decoder 60 converts a coded 3 bit (3 line) binary signal which is output on output ports P14, P15 and P16 of the microcomputer CPU into an 8 line binary signal, which comprises an on level on either one of the lines and off levels at the remaining seven lines. Thus, this signal selects one of eight lines. The output lines of the decoder 60 are connected to select control terminals SEL of the output switching circuit 90.

Figure 4:
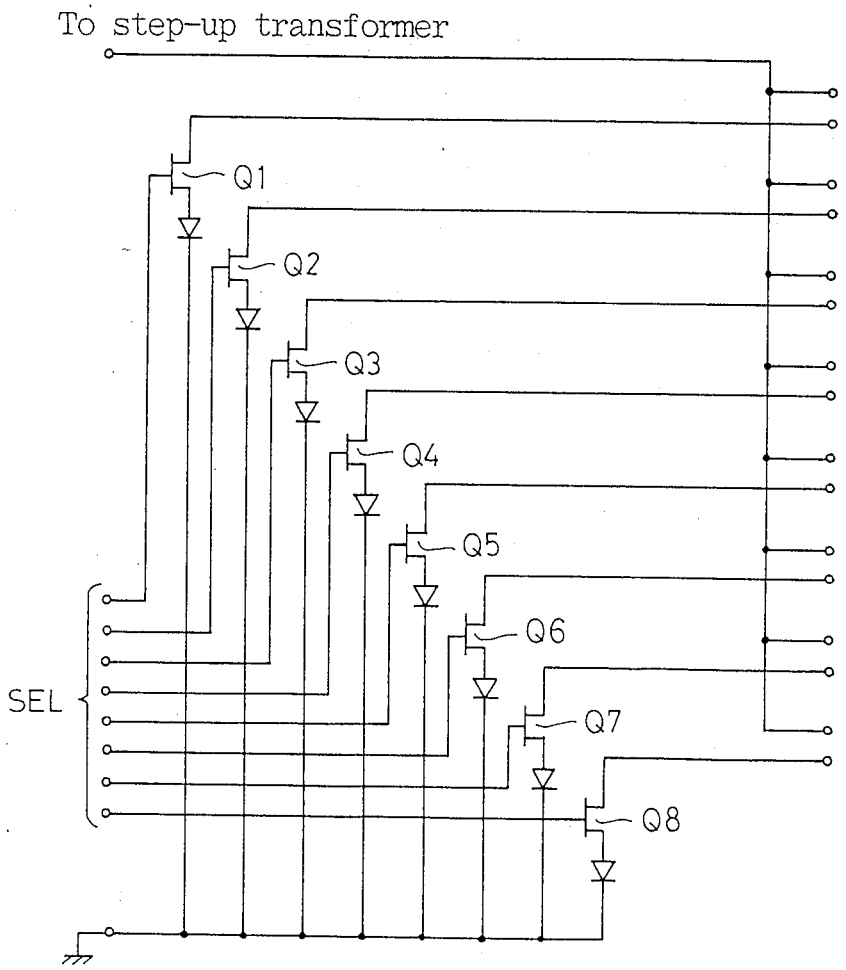
FIGS. 4 and 5 are circuit diagrams of an output switching circuit and a signal processing circuit shown in FIG. 3.

FIG. 4 shows the arrangement of the output switching circuit 90. Referring to FIG. 4, the circuit comprises eight transistors (FET) Ql, Q2, Q3, Q4, Q5, Q6, Q7 and Q8. Each of the transistors Ql to Q8 has its control terminal or gate connected to one of the select control terminals SEL. Each transistor Ql to Q8 has its source terminal connected to the ground through a diode. The drain terminal of each transistor Ql to Q8 as well as one terminal of the step-up transformer are connected to individual one of the eight ultrasonic transmitters of the detector unit SEU through pairs of lines.

Referring to FIG. 3, each of the eight ultrasonic receivers in the detector unit SEU is connected to one of signal input terminals x0 to x7 of the switching circuit 100, which represents an eight channel analog multiplexer, functioning to pass a signal applied to a selected one of the signal input terminals x0 to x7 selectively to its output terminal Y. The selection is controlled by a three bit control signal which is applied to control terminals A, B and C, which are in turn connected through the inverter 70 to output ports P10, Pll, P12, respectively, of the microcomputer CPU. The output terminal Y of the switching circuit 100 is connected to a signal input terminal IN of the signal processing circuit 80, an output terminal OUT of which is connected to an input port TO of the microcomputer CPU. The signal processing circuit 80 has a control terminal CTRL which is connected to an output port P20 of the microcomputer CPU.

Figure 5:
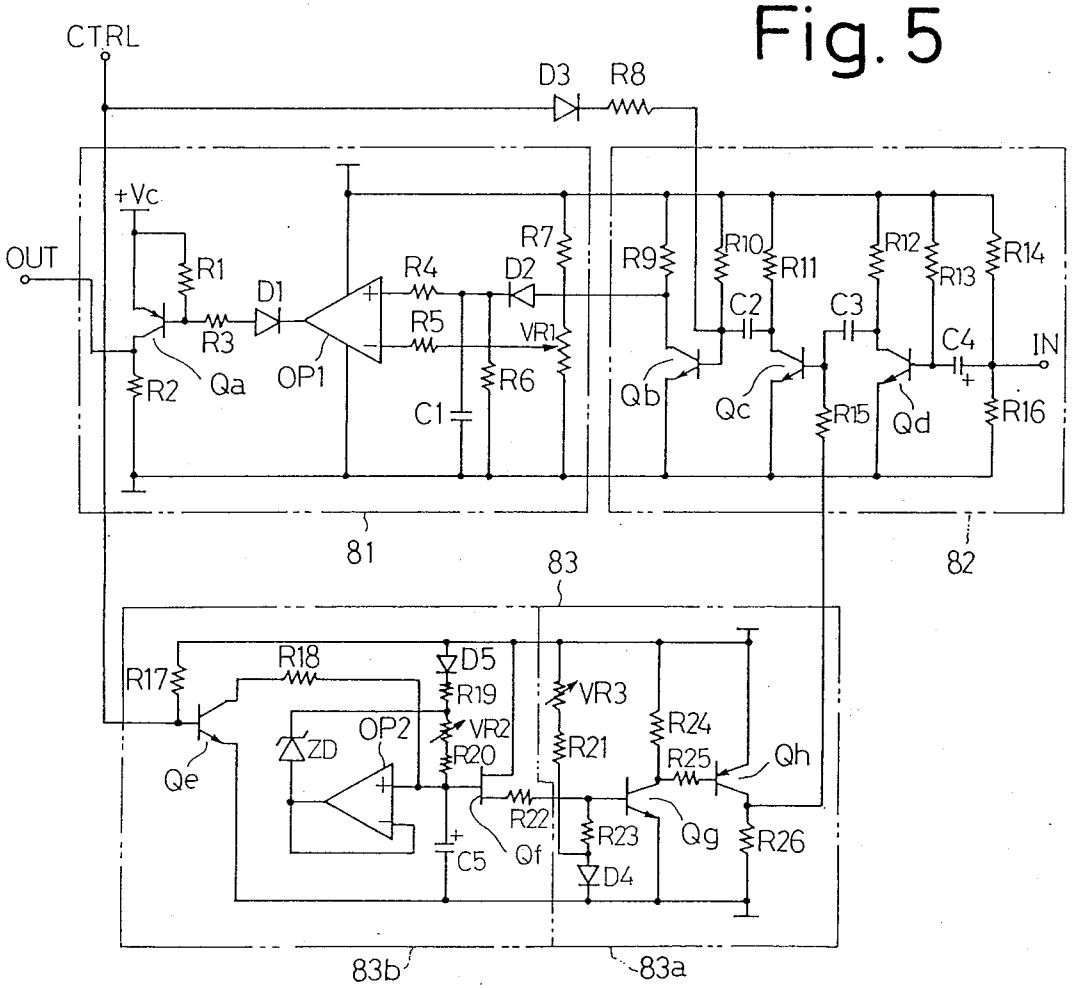

FIG. 5 shows the circuit arrangement of the signal processing circuit 80 shown in FIG. 3. Referring to this Figure, the processing circuit 80 can be considered as divided into three circuit sections 81, 82 and 83. Circuit section 81 represents an analog comparator which compares the level of an inputted analog signal against a given level to produce a corresponding binary signal. Circuit section 82 represents an amplifier having a variable amplification factor. Circuit section 83 represents a function generator having an output level which changes exponentially with an elapsed time t since the level on the control terminal CTRL has changed from its high level H to its low level L. Provided parameters except for the distance between the detector and the object remain constant, there is obtained a signal of constant level at the output of the amplifier 82. This fundamental principle will be described first.

Figure 7A:
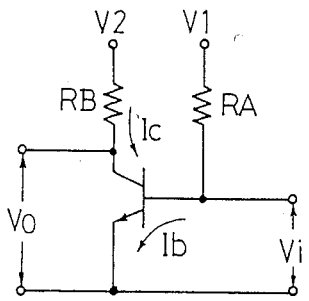
FIG. 7*a* is a circuit diagram which represents an equivalent circuit of part of a circuit shown in FIG. 5.

A transistor amplifier as illustrated in FIG. 7*a* will be considered. Assuming that RA>> rie where "rie" represents the input impedance of a transistor, we have $$Ib = V1/RA \tag{6}$$

Considering Ib as representing the forward diode current, $$Ib = Ib_0\,(e^{\alpha} - 1) \tag{7}$$

where $\alpha = a \cdot Vbe$, $Ib_0$ and a are constants, and Vbe represents a base-emitter voltage. By combining the equations (6) and (7), we have $$Vbe = (1/a) \cdot \ln(V1/((RA \cdot Ib_0) + 1)) \tag{8}$$

Since $Ic = hfe \cdot Ib$ and $V_0 = V_2 - Rc \cdot Ic$ where hfe represents the current amplification factor of a transistor, we have $$\begin{aligned} V_0 &= V_2 - RB \cdot hfe \cdot Ib \\ &= V_2 - RB \cdot hfe \cdot Ib_0(e^{\alpha} - 1) \end{aligned} \tag{9}$$

where $\alpha = a \cdot Vbe$. Representing the voltage Vbe which is obtained when the input signal Vi is equal to zero by $Vbe_0$ (bias voltage), it follows that $Vbe = Vbe_0$ when there is no signal and $Vbe = Vbe_0 + Vi$ when a signal is present. Accordingly, a change in the output voltage V0 in response to the presence or absence of a signal or an output signal level ΔV can be expressed as follows:

$$\Delta = RB \cdot hfe \cdot Ib_0 \cdot e^{\alpha}(1 - e^{Vi}) \tag{10}$$

In the embodiment, the input signal Vi represents V(t) shown in the equation (4). Accordingly, the purpose will be attained when ΔV is maintained constant independently from the time t. Substitution of the equations (4) and (8) into the equation (10) yields $$\Delta V = RB \cdot hfe \cdot Ib_0 \cdot e^{\ln\left(\frac{V1}{RA \cdot Ib0} + 1\right)} \cdot \left(1 - e^{\frac{k4}{t} \cdot e - 2k_1 t}\right) \tag{11}$$

where $k_4 = k_2 \cdot Pl$. Assuming that the transistor is operated in a small current region, hfe can be considered as constant. Modifying the equation (11) in this manner, the condition to achieve a constant value of ΔV can be expressed as follows:

$$e^{\ln\left(\frac{V1}{RA \cdot Ib0} + 1\right)} \cdot \left(1 - e^{\frac{k4}{t} \cdot e - 2k_1 t}\right) = \text{constant} \tag{12}$$

Further modifying, we have $$\ln\left(\frac{V1}{RA \cdot Ib_0} + 1\right) = \ln \frac{k_5}{e^{\frac{k4}{t} \cdot e - 2k_1 t} - 1} \quad (13)$$

where $k_5$ represents a constant. This can be further rewritten as follows:

$$V1 = RA \cdot Ib_0 \cdot \left(\frac{k}{e^{\frac{k4}{t} \cdot e - 2k_1 t} - 1} - 1\right) \quad (14)$$

where k represents a constant.

Figure 7B:
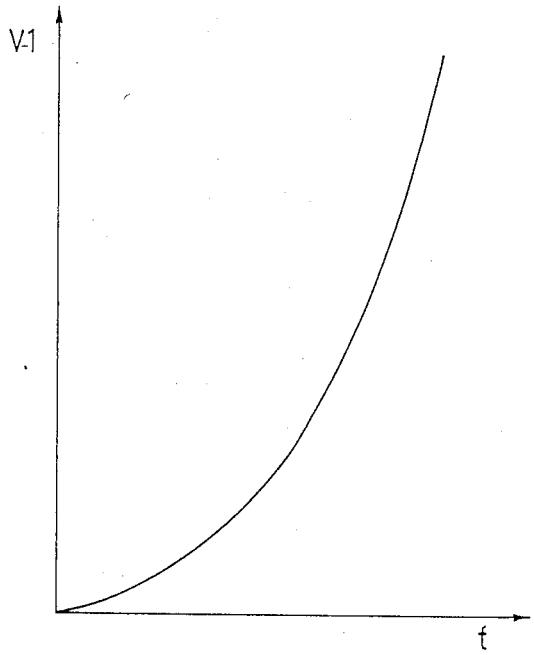
FIGS. 7*b* and 7*c* graphically show the characteristics of several circuits shown in FIG. 5.

It will be seen that the equation (14) represents an exponential function, which is graphically illustrated in FIG. 7*b*. Accordingly, when the voltage Vl is changed in accordance with the function defined by the equation (14) in the transistor amplifier shown in FIG. 7*a*, there is obtained an output signal having a level which does not change with time t in response to the application of a signal voltage V(t) having a level which changes with time t. The amplifier 82 shown in FIG. 5 includes a circuit which corresponds to the circuit shown in FIG. 7*a*. Specifically, the transistor shown in FIG. 7*a* corresponds to the transistor Qc shown in FIG. 5 while resistors R15 and R11 shown in FIG. 5 corresponds to resistors Ra and Rb shown in FIG. 7*a*. Hence when the output level from the function generator 83 changes in accordance with the equation (14), the output level obtained from the amplifier 82 will be constant independently from the time t.

One way to develop an exponential function is to use a diode. Specifically, a forward current If passing through a diode or PN junction is generally expressed as follows:

$$If = Is \cdot (e\alpha - 1) \quad (15)$$

where $\alpha = q\ V/kT$, q represents the charge of an electron, V an applied voltage, k Boltzmann's constant and a constant temperature T. Thus, the forward current through a diode assumes a value which is defined by an exponential function of a voltage applied across the diode.

Figure 7C:
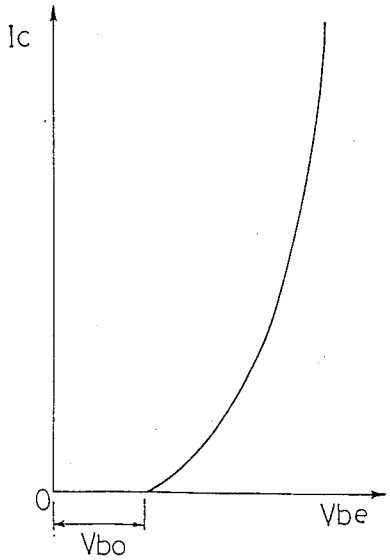

Referring to FIG. 5, the function generator 83 is arranged to develop a function by utilizing the PN junction across the base and emitter of transistor Qg. The relationship between the base-emitter voltage Vbe and the collector current Ic of the transistor is graphically shown in FIG. 7*c*. It is seen that the collector current Ic will be equal to zero for the voltage Vbe less than $Vb_0$, thus deviating from the curve of an exponential function. The voltage $Vb_0$ has a value generally on the order of 0.6 to 0.7 volt. Accordingly, in the example shown in FIG. 5, a bias circuit is used to establish a bias voltage to the transistor Qg which is close to $Vb_0$ when there is no signal input. The bias circuit comprises a variable resistor VR3, resistors R21 and R23 and diode D4. Thus, the relationship between the terminal voltage of and the current passing through the diode D4 is represented by a curve which is similar to that graphically shown in FIG. 7*c*. Thus, by passing a current having a magnitude equal to or greater than a given value through the diode D4, the diode may have an anode voltage on the order of 0.6 V. This voltage can be changed by adjusting the variable voltage VR3. Such voltage is applied through resistor R23 across the base and the emitter of the transistor Qg as a bias voltage.

Circuit portion **83*b* including transistors Qe, Qf, operational amplifier OP2, Zener diode ZD, and a capacitor C5 functions as a ramp signal generator having an output level which changes linearly with a given ramp with time t. Specifically, when the control terminal CTRL has a high level H, the transistor Qe is turned on to discharge the capacitor C5, reducing the terminal voltage across the capacitor to zero, producing no change. However, when the control terminal CTRL has a low level L, the transistor Qe is turned off, ceasing to discharge the capacitor C5. On the other hand, a circuit comprising the operational amplifier OP2 and the Zener diode ZD automatically controls the terminal voltage across the series combination of the variable resistor VR2 and resistor R20 so as to coincide with the Zener voltage Vz which remains substantially constant. Accordingly, the magnitude of the current I passing through the variable resistor VR2 and resistor R20 is controlled to be constant. This current charges the capacitor C5**. Representing the terminal voltage across the capacitor by V, its capacitance by C and the charge stored thereon by Q, it is known that these variables are related to each other by the following equation:

$$V = Q/C \quad (16)$$

Since the charging current I of the capacitor C5 is constant, it follows that $Q = I \cdot t$ before its charging is completed. In other words, the terminal voltage VC(t) across the capacitor C5 at a given time t is expressed as follows:

$$VC(t) = I \cdot t/C \quad (17)$$

Thus, the voltage VC(t) increases with a given ramp, with time t. The ramp can be controlled by changing the current I or by adjusting the variable resistor VR2. The voltage VC(t) is applied to the base terminal of the transistor Qg through FET transistor Qf and resistor R22, the transistor Qf operating as a buffer.

Figure 6:
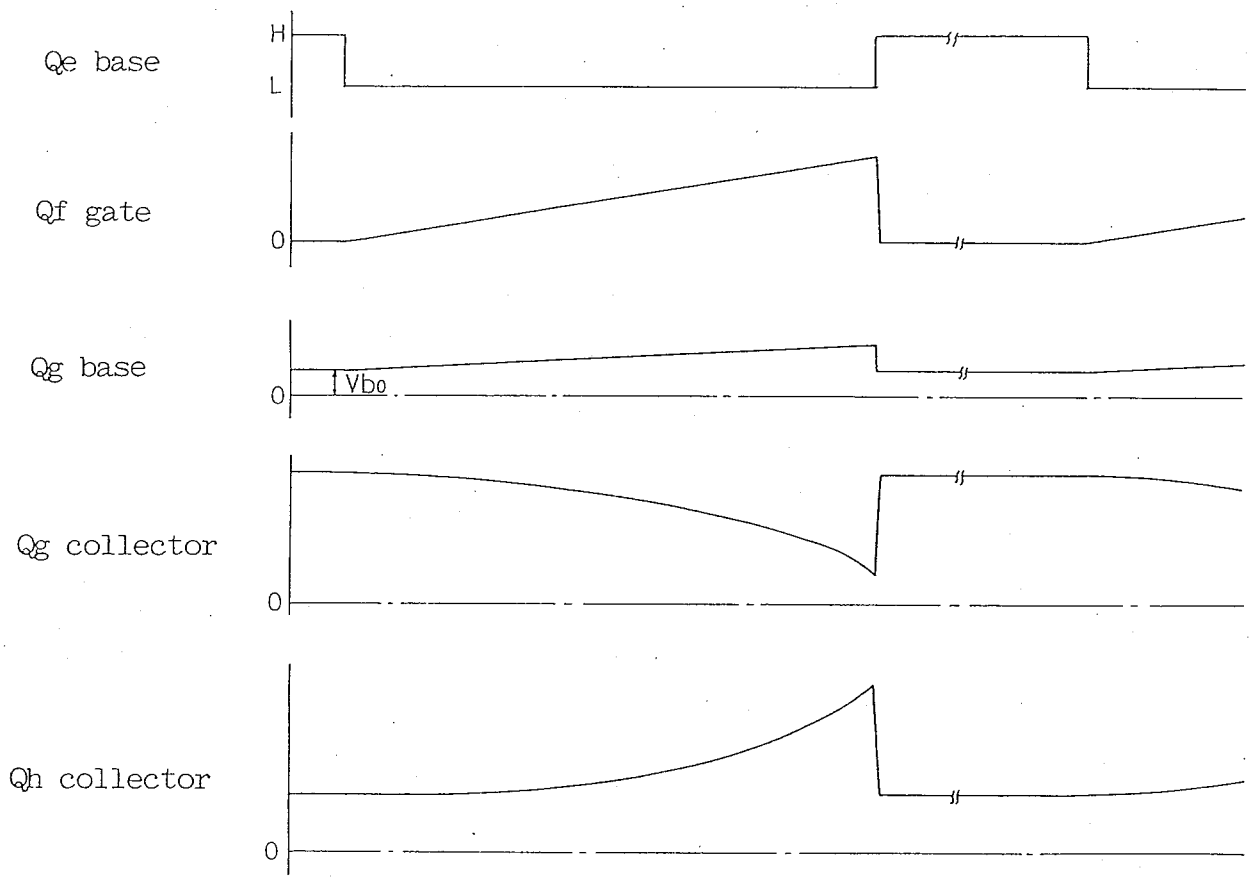
FIG. 6 graphically shows a series of waveforms of signals appearing at various points in the circuit shown in FIG. 5.

FIG. 6 graphically shows the waveforms of signals appearing at various points within the function generator 83. Referring to FIG. 6, it will be seen that by simply applying a binary signal to the base terminal of the transistor Qe, there is obtained an output voltage at the collector terminal of the transistor Qh which changes as a exponential function of the elapsed time t since the binary signal has been set to its low level L. The exponential response can be controlled by adjusting the variable resistors VR2 and VR3. Accordingly, by applying a low level L to the control terminal CTRL in synchronized relationship with the timing of transmission of an ultrasonic wave, the amplification factor of the amplifier 82 is automatically controlled with elapsed time t. Consequently, the signal level obtained at the output terminal of the amplifier 82 is maintained constant if the distance to be determined changes. When a high level H is applied to the control terminal CTRL at the completion of the measurement, the transistor Qb is turned on, resetting the output level of the amplifier 82 to zero.

The analog comparator 81 compares the output level of the amplifier 82 against the output level from the variable resistor VR1, thus producing a binary signal which indicates the result of comparison. It will be seen that this signal assumes a low level L when an object is detected.

Returning to FIG. 3, the display unit DSU comprises fifteen light emitting diode indicators LE1 to LE15 and a three digit, 7 segment numerical display NDS for displaying information which is the output from the microcomputer CPU. The indicators LE1 to LE15 indicate the location (direction) of an object while the numerical display NDS indicates the distance to an object being determined.

FIGS. 8*a* to 8*f* illustrate the operation performed by the microcomputer CPU shown in FIG. 3. Initially referring to FIG. 8*a*, the general operation will be described. When the power supply is turned on, "initialization" subroutine is executed to initialize various parts of the microcomputer. Subsequently, "sequential detection" subroutine, "calculating minimum" subroutine and "display" subroutine are executed in a sequential manner, the program repeatedly executing these subroutines in a loop fashion.

Generally, in the "sequential detection" subroutine, one pair of transmitters and receivers are selected for measurement, and the pair selected is shifted sequentially to repeat the measurement. Upon detecting the presence of an object, data representing the distance to this object is written into a memory which corresponds to the pair selected. In the "calculating minimum" subroutine, a minimum value of data stored among the memories is searched for. In the "display" subroutine, information corresponding to the minimum value which has been searched out by the "calculating minimum" subroutine is displayed.

Figure 8A:
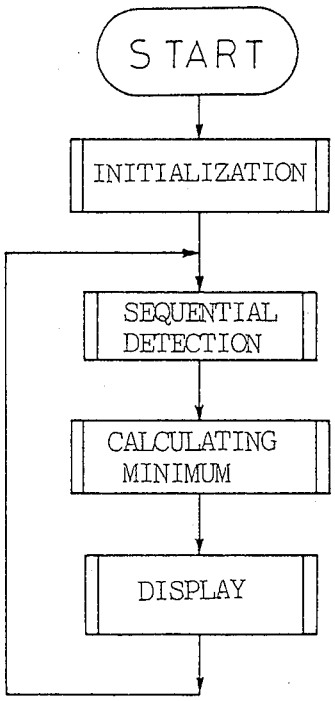
FIGS. 8*a*, 8*b*, 8*c*, 8*d*, 8*e* and 8*f* are flowcharts illustrating the operation by a microcomputer CPU shown in FIG. 3.
Figure 8B:
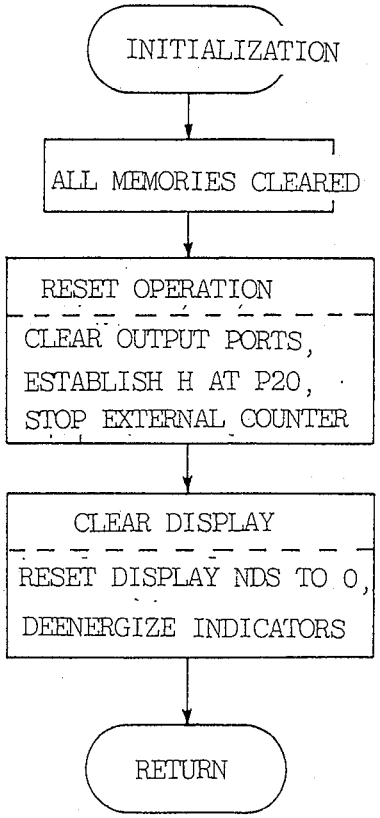

Referring to FIG. 8*b*, "initialization" subroutine will be described. Memories, registers and flags are initially cleared. The operating status of the apparatus is then reset. Thus, output ports are cleared, a high level H is established at the output port P20, and the operation of the external counter is stopped. The display unit is then initialized so that the numerical display NDS indicates "0" while all of indicators LE1 to LE15 are deenergized.

Figure 8C:
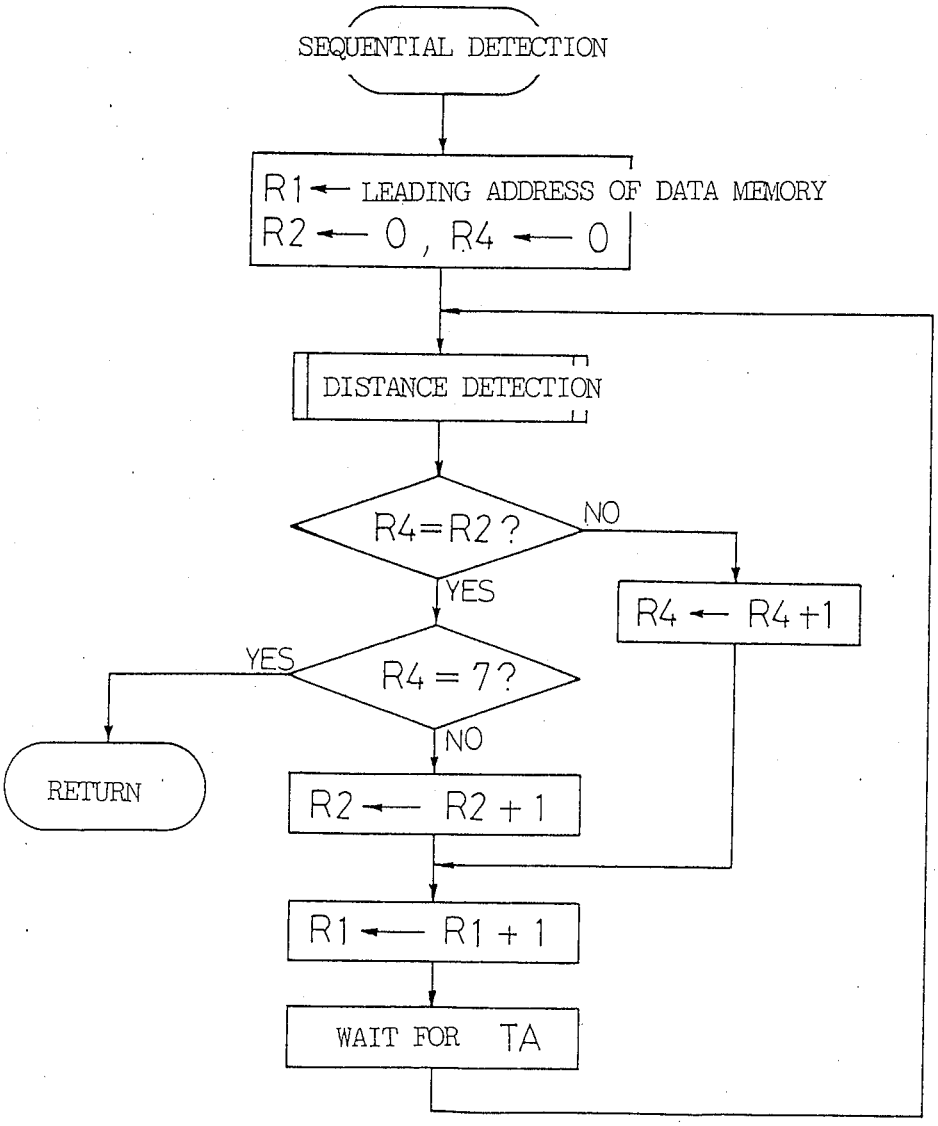

Referring to FIG. 8*c*, the "sequential detection" subroutine will be described. Various registers are initially reset. Thus the leading address of a data memory is loaded into a register R1, and "0" is preset into registers R2 and R4. Registers used in this subroutine are described below.

R1 . . . This register stores reference information for a memory address at which the result of a measurement is to be stored.

R2 . . . This register stores information which indicates which transmitter element is to be selected. Such information is delivered to ports P14, P15 and P16.

R4 . . . This register stores information indicating which receiving element is to be selected. Such information is delivered to ports P10, Pll and P12.

When proper data is loaded into these registers, "distance detection" subroutine is executed where an ultrasonic wave is actually transmitted, and the presence or absence of any reflected wave as well as the distance to an object are determined. A particular transmitter which is selected depends on the content of the register R2, and a particular receiver which is selected depends on the content of the register R4. However, it is to be understood that a combination of transmitter and receiver which are simultaneously selected are those located adjacent to each other.

When the "distance detection" subroutine is completed, the content of the register R2 is compared against the content of the register R4. For the first run, both registers have an equal content and the content in the register R4 is not equal to 7, and accordingly, the content of the register R2 is incremented by one. For example, if R2 is initially equal to 1, it is incremented to 2. The content of the register R1 is then incremented by one, and after waiting for a given time interval TA, the "distance detection" subroutine is executed again. Since the content of the register R2 is updated by the described operation, a particular transmitter which is selected during the "distance detection" subroutine of the second run is changed to TX2. Thus, the receiver remains unchanged from the previous run while the location of the transmitter is shifted by one to the right, as viewed in FIG. 2*a*. In this manner, the location of a particular detector unit used shifts by an amount corresponding to a pitch with which adjacent transmitters and receivers are disposed. Since the content of the register R2 has been updated, the content of the register R2 does not compare with the content of the register R4. Accordingly, the content of the register R4 is incremented by one. Thus, if R4 is initially equal to 1, it is incremented to 2. The content of the register R1 is again incremented by one, and after waiting for the given time interval TA, the "distance detection" subroutine is executed again. Since the register R4 has been updated, a particular receiver which is selected during the "distance detection" subroutine of the third run is changed to RX2. In this instance, the transmitter remains unchanged from the previous run while the receiver shifts by one to the right, as viewed in FIG. 2*a*. Thus, a particular detector unit used shifts by an amount corresponding to the pitch mentioned above. By updating the register R4, the register R2 compares with R4 again, and therefore the content of the register R2 is now incremented, changing a particular transistor which is selected. Such operation is subsequently repeated, alternately changing a transmitter and a receiver which are selected, followed by the execution of the "distance detection" subroutine. When the content of the register R4 is equal to 7, this means that the detection has been completed at all of the detector units, and hence the program exits from the "sequential detection" subroutine and returns to the main routine. The execution of the "distance detection" subroutine in a repeated manner produces results of measurement obtained at fifteen locations.

Figure 8D:
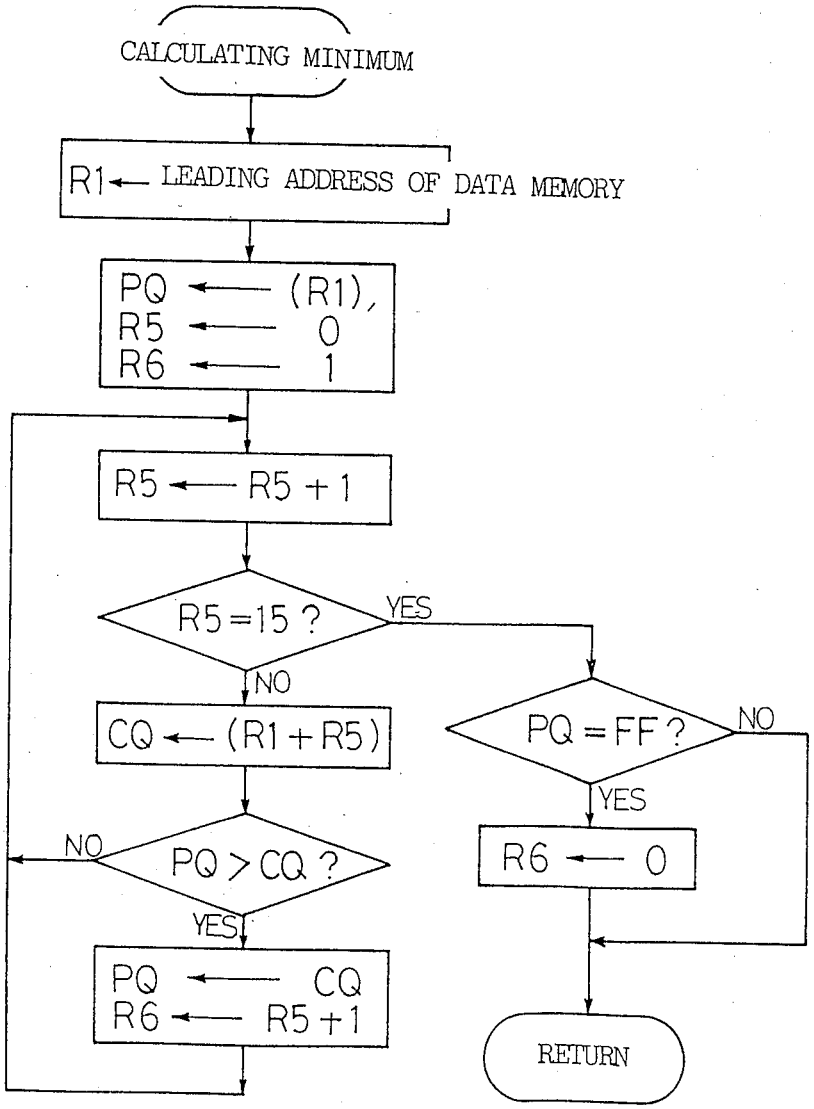
Figure 8E:
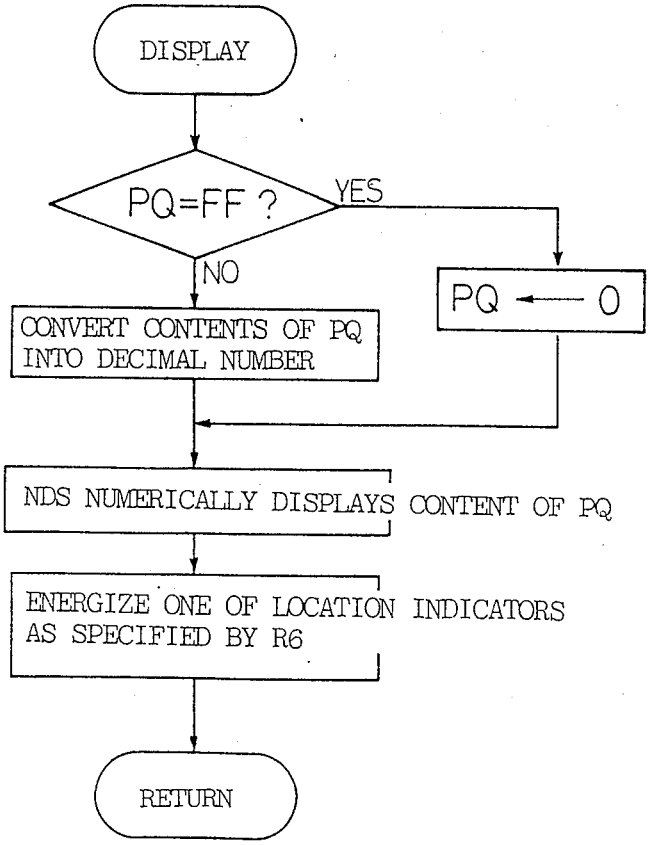
Figure 8F:
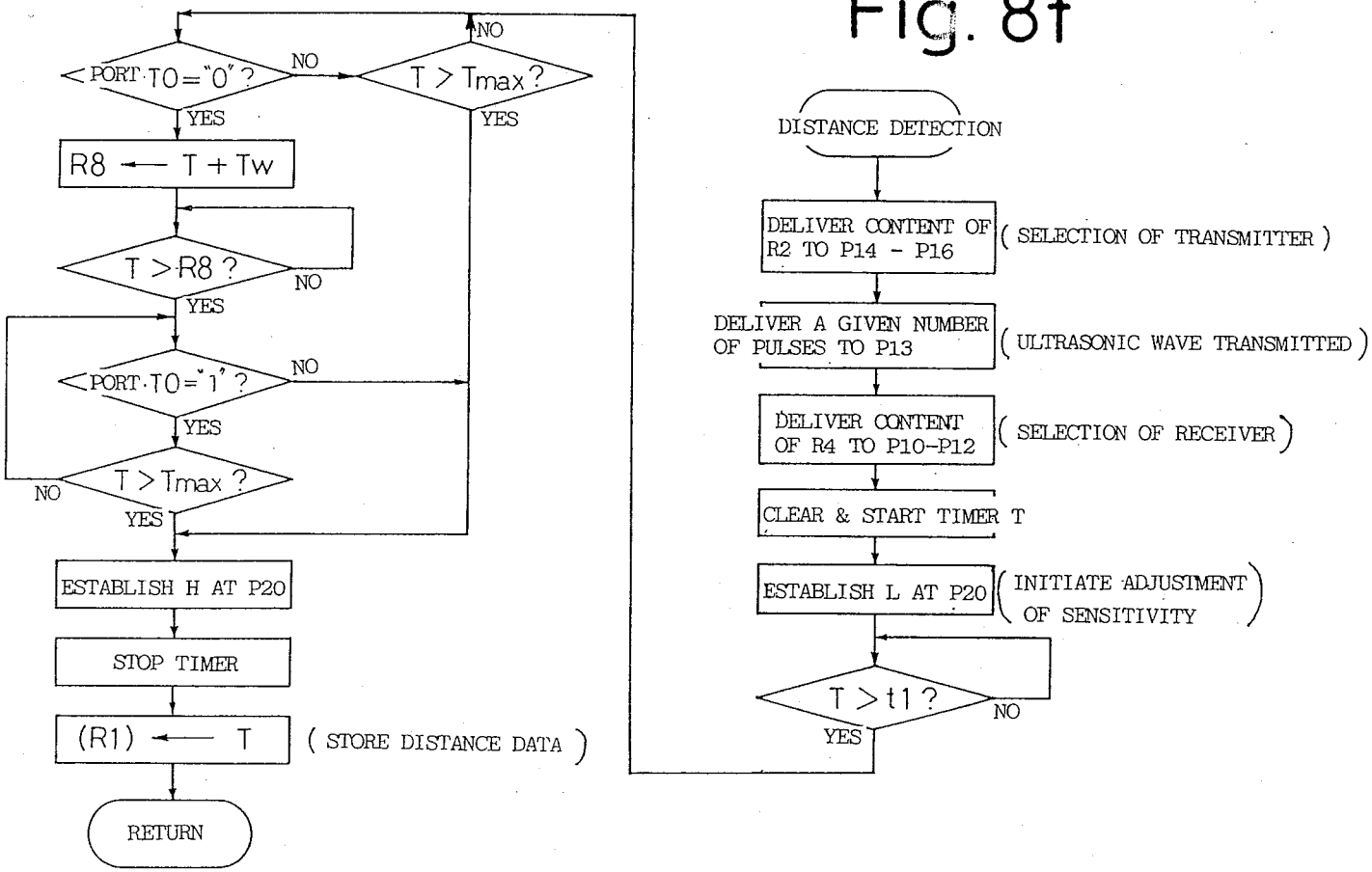

The detail of the "distance detection" subroutine is shown in FIG. 8*f*. Before describing this subroutine, nomenclature used in this subroutine will be described below.

T . . . Timer.

tl . . . A value of time when the influence of a direct wave is at its maximum as measured from the transmission of an ultrasonic wave.

Tw . . . A marginal value of time.

Tmax . . . A maximum time interval used during the "distance detection" subroutine, which is fixed.

Upon entry in this subroutine, the content of the register R2 is initially delivered to the ports P14, P15 and P16 for selecting one of the transmitters. A given number of pulses having a given period (40 kHz) is delivered to the port P13, thus causing an ultrasonic wave to be transmitted. The content of the register R4 is delivered to the ports P10, P11 and P12 for selecting one of the receivers. The timer T is cleared and started, and a low level L is established at the port P20, whereupon an automatic adjustment of the amplification factor of the amplifier 82 is initiated. The described processing steps are executed in a substantially parallel timing relationship.

The program then waits for the value in the timer T to reach a given time interval t1, whereupon the status at the input port T0 is examined. As mentioned previously, the status L (which is equivalent to "0") on this signal line indicates the detection of the ultrasonic wave or a reflected wave while the status H (equivalent to "1") indicates a failure to detect the ultrasonic wave. It will be understood that for a given time interval beginning with the transmission of an ultrasonic wave, various influences of a direct wave will be manifest on the receiver which are attributable to an electromagnetic induction between the signal lines of the transmitter and the receiver, a diffraction of the ultrasonic wave and the transmission of mechanical oscillations through the support member of the detector. The effect of these influences will be at its maximum at time t1, and causes a detected level "0" to appear at the input port T0 if the existence of an object is not actually detected. For this reason, the program waits for these influences of the direct wave to subside or until the port T0 assumes "1". Where the level of the direct wave has oscillations, the port T0 may initially assume "1" and then again assume "0". To accommodate for this, at the time when the port T0 assumes "1", the prevailing value T in the timer is added with a given marginal time Tw, and the sum is loaded into a register R8, and the program waits for the timer T to exceed the content of the register R8, thus for the waiting time Tw. When the time Tw has passed, the actual detection is initiated. The input port T0 is examined until the time reaches Tmax. When the input port T0 assumes "0", indicating that the existence of an object has been detected, or when the time reaches Tmax, a high level H is established at the port P20 and the timer T is stopped, with a value contained therein stored in a memory represented by the register R1, thus completing the processing operation.

Referring to FIG. 8*d*, the "calculating minimum" subroutine will be described. Nomenclature used in this subroutine is as follows:

R1 . . . A register which stores the leading address of a data memory.

R5 . . . A register which retains an offset of the address of a memory being used from R1.

R6 . . . A register which retains a value of location representing the minimum distance that has been detected up to that point in time.

PQ . . . A register storing a minimum value of data which has been addressed until the previous run.

CQ . . . A register which stores data that is now addressed.

In this subroutine, the leading address of a data memory is initially loaded into the register R1 and the content of a memory having an address indicated by the value in the register R1 is loaded into the register PQ, 0 is loaded into the register R5, and 1 is loaded into the register R6. The subsequent operation takes place by repeating a loop.

Initially, the content of the register R5 is incremented by one, and is then compared against 15. If it is not equal to 15, the sum of the content of the registers R1 and R5 is formed to define an address, which is used to read a data memory. The value read from the data memory is stored in the register CQ. The content of the register PQ is compared against the content of the register CP, and if PQ>CQ, the content of the register CQ is transferred to the register PQ, with the register R6 storing a value equal to the content of the register R5 plus one. Thus, if data having a magnitude which is less than the old data that represents the minimum value up to that point in time is found, the register PQ is updated with a new minimum value. When the value in the register R5 reaches 15 as a result of repeating the loop operation, or when the final data has been compared, the content of the register PQ is compared against a maximum value FF (which is equivalent to 255 in decimal notation). Thus, when the existence of an object is not detected at any location of the detector unit, the maximum value FF which is initially loaded into the register PQ remains, and hence the register R6 is reset to 0 to indicate a failure to detect the existence of an object. When the described operation has been completed, the program exists from the "calculating minimum" subroutine.

Referring to FIG. 8*e*, the "display" subroutine will be described. In this subroutine, the content of the register PQ is initially compared against the maximum value FF. If the content of the register PQ is equal to the maximum value FF, indicating a failure to detect the existence of an object, the register PQ is reset to 0. If the existence of an object has been detected, the content of the register PQ is converted into a decimal value. The content of the register PQ or the distance to the object is displayed by the numerical display NDS while activating one of the fifteen light emitting diodes LE1 to LE15 in accordance with the contents of the register R6 to indicate the location of the object. It is to be noted that a content from 1 to 15 of the register R6 corresponds to light emitting diodes LE1 to LE15, respectively. When the register R6 contains 0, all the light emitting diodes are deactivated.

From the foregoing, it will be appreciated that the invention enables a signal of a given level to be obtained independently from the distance without requiring a stepwise change in the detection sensitivity, thus allowing a ranging operation in a single operation and reducing the time required. Accordingly, no time lag in the detection is involved if a plurality of transmitters and receivers are used to perform the detection of an object at successive different locations, as disclosed by the embodiment.

What is claimed is:

1. A reflective object detector comprising object detecting means including signal transmitting means and signal receiving means which receives a reflection of a signal transmitted from the signal transmitting means;

means for energizing the signal transmitting means;

amplifier means responsive to an output signal from the signal receiving means, an amplification factor thereof changing with time in accordance with a given exponential function when a control signal applied thereto is turned "on";

annunciator means for producing at least one of a visible indication or audible output;

and electronic control means for controlling the energizing means to energize the signal transmitting means, for turning a control signal applied to the amplifier means to an "on" level, and for monitoring an output level from the amplifier means to energize the annunciator means when the output level reaches a given value.

2. A reflective object detector according to claim 1 in which the amplifier means comprises ramp signal generating means responsive to said control signal and having an output level which changes in proportion to an elapsed time since the control signal is switched to its "on" level, non-linear signal processing means connected to the output of the ramp signal generating means and a variable amplification amplifier having an amplification factor which depends on a signal level which is output from the non-linear signal processing means.

3. A reflective object detector according to claim 2 in which the ramp signal generating means includes ratio regulating means which regulates the ratio of a change in the output level to the elapsed time.

4. A reflective object detector according to claim 2 in which the non-linear signal processing means includes signal translating means, and bias adjusting means which adjusts a bias level applied to the signal translating means.

5. A reflective object detector according to claim 1 in which the electronic control means responds to an output level from the amplifier means which is equal to or greater than a given value to calculate the distance to an object in accordance with an elapsed time since the signal transmitting means has been energized and energizes the annunciator means in accordance with the result of the calculation.

6. A reflective object detector according to claim 1 in which at least one of the signal transmitting means and the signal receiving means is provided as a plurality of means, the electronic control means selecting from a plurality of signal transmitting means and/or signal receiving means and energizing the annunciator means in accordance with a position of the selected means.

7. A reflective object detector according to claim 1 in which the signal transmitting means comprises ultrasonic wave transmitting means and the signal receiving means comprises ultrasonic wave receiving means.

8. A reflective object detector comprising object detecting means including ultrasonic wave transmitting means and ultrasonic wave receiving means which receive a reflection of the ultrasonic wave transmitted by the ultrasonic wave transmitting means;

means for energizing the ultrasonic wave transmitting means;

amplifier means including ramp signal generating means having an output level which changes in proportion to an elapsed time since a control signal applied thereto is switched to its "on" level, non-linear signal processing means connected to the output of the ramp signal generating means, and a variable amplification amplifier having an amplification factor which depends on a signal level which is output from the non-linear signal processing means, the output terminal of the ultrasonic wave receiving means being connected to the input terminal of the variable amplification amplifier, the amplifier means changing its amplification factor with time in accordance with a given exponential function when the control signal is switched to its "on" level;

annunciator means for producing at least one of a visible output and an audible output;

and electronic control means for controlling the energizing means to energize the ultrasonic wave transmitting means, for switching the control signal applied to the amplifier means to its "on" level, and for monitoring an output level from the variable amplification amplifier to energize the annunciator means whenever the output level reaches or exceeds a given value.

9. A reflective object detector according to claim 8 in which the ramp signal generating means includes ratio regulating means for regulating the ratio of a change in the output level to the elapsed time.

10. A reflective object detector according to claim 8 in which the non-linear signal processing means includes signal translating means and bias adjusting means which adjusts a bias level applied to the signal translating means.

11. A reflective object detector according to claim 8 in which the electronic control means is responsive to an output level from the amplifier means which is equal to or greater than the given value to calculate the distance to an object as a function of an elapsed time since the signal transmitting means has been energized and to energize the annunciator means in accordance with the result of the calculation.

* * * * *